US008172566B2

(12) United States Patent
Watson et al.

(10) Patent No.: US 8,172,566 B2
(45) Date of Patent: May 8, 2012

(54) LIQUID FUEL COMBUSTION PROCESS AND APPARATUS

(75) Inventors: Matthew James Watson, Bethlehem, PA (US); Xiaoyi He, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 50 days.

(21) Appl. No.: 12/708,166

(22) Filed: Feb. 18, 2010

(65) Prior Publication Data

US 2011/0200955 A1 Aug. 18, 2011

(51) Int. Cl.

| | |
|---|---|
| ***B05B 7/00*** | (2006.01) |
| ***B05B 7/04*** | (2006.01) |
| ***F23C 5/14*** | (2006.01) |
| ***F23C 7/00*** | (2006.01) |
| ***F23C 7/02*** | (2006.01) |

(52) U.S. Cl. ..... 431/8; 239/432; 239/434.5; 431/10; 431/12; 431/159; 431/181; 431/187; 431/188; 431/190; 431/164; 431/350

(58) Field of Classification Search ..... 431/2, 8, 431/10, 12, 159, 164, 165, 181, 187, 188, 431/190, 350, 351; 239/398, 405, 406, 419, 239/423, 424, 424.5, 429, 430, 433, 432, 239/434.5

See application file for complete search history.

(56) References Cited

U.S. PATENT DOCUMENTS

| | | | | | |
|---|---|---|---|---|---|
| 1,100,141 | A | * | 6/1914 | McConnell | 239/405 |
| 1,559,625 | A | * | 11/1925 | Kutis | 239/405 |
| 1,564,064 | A | * | 12/1925 | Hannah | 239/405 |
| 1,813,083 | A | * | 7/1931 | Pyankow | 239/402.5 |
| 2,050,368 | A | * | 8/1936 | Neely | 239/406 |
| 2,762,656 | A | * | 9/1956 | Fraser | 239/404 |
| 2,984,421 | A | * | 5/1961 | Hession, Jr. | 239/402.5 |
| 3,013,732 | A | * | 12/1961 | Webster et al. | 239/404 |
| 3,717,306 | A | * | 2/1973 | Hushon et al. | 239/404 |
| 3,790,086 | A | * | 2/1974 | Masai | 239/406 |
| 5,092,760 | A | | 3/1992 | Brown et al. | |
| 5,199,866 | A | * | 4/1993 | Joshi et al. | 431/353 |
| 5,307,635 | A | * | 5/1994 | Graves et al. | 60/740 |
| 5,393,220 | A | | 2/1995 | Couwels et al. | |
| 5,547,368 | A | | 8/1996 | Slavejkov | |
| 5,567,141 | A | | 10/1996 | Joshi et al. | |
| 5,575,637 | A | | 11/1996 | Slavejkov | |
| 5,611,682 | A | | 3/1997 | Slavejkov | |
| 5,617,997 | A | | 4/1997 | Kobayashi et al. | |

(Continued)

OTHER PUBLICATIONS

Osamu A. Wakita and Richard M. Linde, The Professional Practice of Architectural Detailing, 1999, John Wiley & Sons, Inc., Third Edition, p. 119.*

(Continued)

*Primary Examiner* — Kenneth Rinehart
*Assistant Examiner* — Joanna Davis
(74) *Attorney, Agent, or Firm* — Bryan C. Hoke, Jr.

(57) ABSTRACT

An apparatus for combustion of a liquid fuel, such as an atomizer or burner, and an associated method using the apparatus for combusting an atomized liquid fuel. The apparatus for combustion has an outer conduit, an inner conduit and a spray tip. The spray tip has a mixing chamber for receiving a liquid fuel and an atomizing gas, and an orifice for discharging the liquid fuel and atomizing gas mixture as an atomized liquid fuel. The inner conduit has external fins where at least some of the external fins contact the inner surface of the spray tip.

21 Claims, 3 Drawing Sheets

U.S. PATENT DOCUMENTS

| | | | | |
|---|---|---|---|---|
| 5,732,885 | A | 3/1998 | Huffman | |
| 5,975,886 | A * | 11/1999 | Philippe | 431/165 |
| 6,068,468 | A * | 5/2000 | Philippe et al. | 431/175 |
| 6,174,161 | B1 | 1/2001 | Slavejkov | |
| 6,334,579 | B1 * | 1/2002 | Zarbi | 239/406 |
| 6,425,755 | B1 * | 7/2002 | Pillard et al. | 431/159 |
| 6,524,097 | B2 | 2/2003 | Hoke, Jr. et al. | |
| 6,817,183 | B2 * | 11/2004 | Modi et al. | 60/748 |
| 6,848,251 | B2 | 2/2005 | Ripper et al. | |
| 7,390,189 | B2 | 6/2008 | D'Agostini | |
| 7,500,849 | B2 | 3/2009 | Dudill et al. | |
| 7,506,822 | B2 * | 3/2009 | Cairo et al. | 239/1 |
| 2002/0125336 | A1 * | 9/2002 | Bretz | 239/8 |
| 2005/0263225 | A1 * | 12/2005 | Dudill et al. | 149/109.6 |
| 2006/0035184 | A1 * | 2/2006 | D'Agostini | 431/10 |
| 2009/0280444 | A1 * | 11/2009 | Watson et al. | 431/10 |

OTHER PUBLICATIONS

Lefebvre, Arthur H., Atomization and Sprays, Hemisphere Publishing Corp., 1989, p. 309.

Roberge, Pierre R., Handbook of Corrosion Engineering, McGraw-Hil, 2000, pp. 710-713.

Speight, James G., Handbook of Petroleum Analysis, Wiley-Interscience, 2001, Chapter 8, pp. 197-221.

Spray Systems Catalogue, Section F—Air Atomizing Spray Nozzles, downloaded Feb. 16, 2010.

* cited by examiner

LIQUID FUEL COMBUSTION PROCESS AND APPARATUS

BACKGROUND

Use of atomizer nozzles is known in the combustion art as illustrated in U.S. Pat. Nos. 5,547,368, 5,567,141, 5,393,220, 5,617,997, and 7,500,849 incorporated herein by reference in their entireties. As described in U.S. Pat. No. 5,547,368, atomizer nozzles are used in industrial melting furnaces for such diverse products as metals, glass, ceramic materials, and the like.

There are many ways of atomizing liquid fuels in combustion applications. The nozzles can be grouped in two major groups:

a) Pressure atomizers, where relatively high liquid fuel pressure is used to drive the flow through a small orifice, which breaks up the liquid into droplets. These atomizers are relatively simple. However, their turn down ratio is narrow requiring nozzle changes for systems that have wide variations in flow requirements.

b) Twin-fluid atomizers, where an atomizing gas is used to assist with liquid atomization. The atomizing gas usually is introduced at higher pressures, while the liquid fuel may be delivered at lower pressures. This group of nozzles can further be segmented into:

1) External-mixing, where the high-velocity atomizing gas meets with lower-velocity liquid fuel externally resulting in liquid-jet breakup, i.e. atomization. These nozzles are usually very rugged, however, the flame shape and atomization quality is most-often sub-optimal, especially in oxy-fuel burner applications. The flames are short, tight, leading to non-uniform heat delivery and local overheating.

2) Internal-mixing or emulsion, where the atomizing gas and liquid fuel are mixed inside an internal chamber, and the two-phase mixture is then ejected through an exit orifice causing liquid breakup due to depressurization of inter-mixed gaseous phase. These nozzles produce excellent and controllable atomization, excellent flame geometry and uniform heat transfer.

While the internal-mixing atomizers are widely used in air-fuel combustion, their use in oxy-fuel burners has been limited due to cooling concerns and possible flame flash-back issues. With non-water-cooled burners, the primary oxidizer cools the atomizing nozzle. For air-fuel burners in which the primary oxidizer is air, cooling is accomplished due to the large volume of air (the primary oxidizer) that is needed and provided for complete combustion. However, for oxy-fuel burners, which are burners utilizing a primary oxidizer with a higher $O_2$ concentration than air, cooling of the atomizing nozzle via the reduced volume of the primary oxidizer may be unsatisfactory. For example, in case of a 100 percent $O_2$ oxidizer, if the stoichiometric required amount of oxygen for combustion is provided, there will be about 80 percent less volume of the primary oxidizer available to cool the atomizing nozzle than in air-fuel burners. In addition, oxy-fuel burners have much higher flame temperatures. For these reasons the atomizing nozzles in oxy-fuel burners are expected to run at much higher temperatures than in air-fuel burners.

Higher internal-mixing nozzle temperatures lead to several potential problems:

1) Elevated nozzle temperatures may cause chemical degradation of liquid fuels prior to their introduction into the furnace. More specifically, for fuel oils, such as heavy oils with high sulfur content, and oils with high carbon residue values, for example, as indicated by a high Conradson Carbon Residue (CCR) number, such as commonly found in fuel oils with high levels of asphaltenes, high nozzle temperatures may lead to internal coke deposition and nozzle plugging. Coke deposition and nozzle plugging requires maintenance such as cleaning of the nozzle. Coke deposition and nozzle plugging is a concern regardless of the atomizing gas used.

2) Additionally, if oxygen is used as the atomizing gas, elevated nozzle temperatures and improper nozzle design may lead to flame flash-back and a catastrophic nozzle failure.

Industry desires a liquid fuel fired burner and a liquid fuel atomizer suitable for use in oxy-fuel fired furnaces.

Industry desires a liquid fuel fired burner and a liquid fuel atomizer that require infrequent cleaning and/or maintenance.

Industry desires a liquid fuel fired burner and a liquid fuel atomizer that are easy to clean.

BRIEF SUMMARY

The present invention relates to an apparatus for combustion of a liquid fuel. The apparatus for combustion may be a liquid fuel atomizer. The liquid fuel atomizer comprises (a) an outer conduit of generally cylindrical shape having an atomizing gas inlet end portion and an atomizing gas discharge end portion, (b) an inner conduit of generally cylindrical shape having a liquid fuel inlet end portion and a liquid fuel discharge end portion, the inner conduit disposed within said outer conduit and forming an atomizing gas passage between said outer conduit and said inner conduit, the atomizing gas passage extending from the atomizing gas inlet end portion to the atomizing gas discharge end portion, and (c) a spray tip having an inlet end portion and a discharge end portion, the inlet end portion of the spray tip joined to the atomizing gas discharge end portion of the outer conduit. The spray tip has (i) a mixing chamber disposed to receive a liquid fuel from the liquid fuel discharge end portion of the inner conduit and disposed to receive an atomizing gas from the atomizing gas discharge end portion of the atomizing gas passage, and (ii) an orifice at the outlet end portion of the spray tip, the orifice disposed to receive the liquid fuel and the atomizing gas from the mixing chamber and for discharging the liquid fuel and the atomizing gas from the spray tip as an atomized liquid fuel. The inner conduit has a plurality of external fins at the liquid fuel discharge end portion of the inner conduit wherein at least some of the plurality of external fins contact an inner surface of the inlet end portion of the spray tip.

The orifice of the liquid fuel atomizer may be an elongated slotted orifice.

The plurality of external fins may have a converging external taper which converges in the direction of the liquid fuel discharge end portion. The spray tip may have a converging internal taper at the inlet end portion which converges in the direction of the outlet end portion, the internal taper generally complementary to the external taper of the plurality of external fins.

The plurality of external fins may be longitudinal fins.

The plurality of external fins may be longitudinal fins and the ratio of length of the plurality of external fins to outer diameter of the outer conduit may be 0.1 to 3.0.

The plurality of external fins may be spiral fins.

The plurality of external fins may number from 3 to 20 or from 6 to 10.

The outer conduit may have a ratio of conduit wall thickness to conduit outer diameter of 0.1 to 0.2.

The apparatus may have a ratio of atomizing gas passage hydraulic diameter to outer diameter of the outer conduit of 0.05 to 0.25.

The apparatus may have a ratio of inner conduit wall thickness to inner conduit outer diameter of 0.2 to 0.7 at an inner conduit cross section having the plurality of external fins.

The apparatus may have $$0.1 \leq \frac{N \times S}{P} \leq 0.9,$$

where N is the quantity of external fins of the plurality of external fins, S is the mean arc length of the external fins of the plurality of external fins, and P is the inner perimeter of the outer conduit at an outer conduit cross section adjacent the plurality of external fins.

The inlet end portion of the spray tip may be joined to the atomizing gas discharge end portion of the outer conduit by a weld joint.

The weld joint may have a thickness of greater than 25% to 100% of the wall thickness of the outer conduit.

The mixing chamber may have a converging internal taper proximate the orifice which converges in the direction of the orifice.

The apparatus for combustion may be an oxy-fuel burner. The burner comprises (I) a first oxidant gas conduit section defining a first oxidant gas passage, the first oxidant gas passage having a first oxidant gas passage inlet end portion and a first oxidant gas passage discharge end portion for discharging a first oxidant gas stream, and (II) a liquid fuel atomizer disposed in spaced relation to the first oxidant gas conduit with at least a part of the liquid fuel atomizer disposed within the oxidant gas passage. The liquid fuel atomizer comprises (a) an outer conduit of generally cylindrical shape having an atomizing gas inlet end portion and an atomizing gas discharge end portion, (b) an inner conduit of generally cylindrical shape having a liquid fuel inlet end portion and a liquid fuel discharge end portion, the inner conduit disposed within said outer conduit and forming an atomizing gas passage between said outer conduit and said inner conduit, the atomizing gas passage extending from the atomizing gas inlet end portion to the atomizing gas discharge end portion, and (c) a spray tip having an inlet end portion and a discharge end portion, the inlet end portion of the spray tip joined to the atomizing gas discharge end portion of the outer conduit. The spray tip has (i) a mixing chamber disposed to receive a liquid fuel from the liquid fuel discharge end portion of the inner conduit and disposed to receive an atomizing gas from the atomizing gas discharge end portion of the atomizing gas passage, and (ii) an orifice at the outlet end portion of the spray tip, the orifice disposed to receive the liquid fuel and the atomizing gas from the mixing chamber and for discharging the liquid fuel and the atomizing gas from the spray tip as an atomized liquid fuel into the first oxidant gas stream. The inner conduit has a plurality of external fins at the liquid fuel discharge end portion of the inner conduit wherein at least some of the plurality of external fins contact an inner surface of the inlet end portion of the spray tip.

The orifice may be an elongated slotted orifice.

The plurality of external fins may have a converging external taper which converges in the direction of the liquid fuel discharge end portion and wherein the spray tip has a converging internal taper at the inlet end portion which converges in the direction of the outlet end portion. The internal taper is generally complementary to the external taper of the plurality of external fins.

The plurality of external fins may be longitudinal fins.

The apparatus may have a ratio of length of the plurality of external fins to outer diameter of the outer conduit of 0.1 to 3.0.

The plurality of external fins may be spiral fins.

The plurality of external fins may number from 3 to 20 or from 6 to 10.

The outer conduit may have a ratio of conduit wall thickness to conduit outer diameter of 0.1 to 0.2.

The apparatus may have a ratio of atomizing gas passage hydraulic diameter to outer diameter of the outer conduit of 0.05 to 0.25.

The apparatus may have a ratio of inner conduit wall thickness to inner conduit outer diameter of 0.2 to 0.7 at an inner conduit cross section having the plurality of external fins.

The inlet end portion of the spray tip may be joined to the atomizing gas discharge end portion of the outer conduit by a weld joint.

The weld joint may have a thickness of 50% to 100% of the wall thickness of the outer conduit.

The mixing chamber may have a converging internal taper adjacent the orifice which converges in the direction of the orifice.

The burner may further comprise a second oxidant gas conduit section defining a second oxidant gas passage proximate the first oxidant gas passage, the second oxidant gas passage for discharging a second oxidant gas stream. The second oxidant gas passage may be located above or below the first oxidant gas passage.

The first oxidant gas passage may have a cross-sectional shape with a width and height of different dimensions, and wherein the first oxidant gas passage has a width to height ratio of 5 to 30, and wherein the second oxidant gas passage has a cross-sectional shape with a width and height of different dimensions, and wherein the second oxidant gas passage has a width to height ratio of 5 to 30.

The burner may further comprise an oxidant inlet manifold in fluid flow communication with the first oxidant gas passage and the second oxidant gas passage, and a staging valve in downstream fluid flow communication with the oxidant inlet manifold and in upstream fluid flow communication with the first and second oxidant gas passage for regulating the flow distribution between the first and second oxidant gas streams to the first and second oxidant gas passages, respectively.

The burner may further comprise an oxidant inlet plenum in upstream fluid flow communication of the first oxidant gas passage, at least a portion of the oxidant inlet plenum being spaced around at least a portion of the liquid fuel atomizer, and an oxidant diffuser located in upstream fluid flow communication of said oxidant inlet plenum.

The present invention also relates to a method for combusting a liquid fuel. The method comprises (A) providing a burner where the burner comprises (I) a first oxidant gas conduit section defining an oxidant gas passage, the first oxidant gas passage having a first oxidant gas passage inlet end portion and a first oxidant gas passage discharge end portion for discharging a first oxidant gas stream, and (II) a liquid fuel atomizer disposed within the oxidant gas passage. The liquid fuel atomizer comprises (a) an outer conduit of generally cylindrical shape having an atomizing gas inlet end portion and an atomizing gas discharge end portion, (b) an inner conduit of generally cylindrical shape and having a liquid fuel inlet end portion and a liquid fuel discharge end portion, the inner conduit disposed within said outer conduit and forming an atomizing gas passage between said outer conduit and said inner conduit the atomizing gas passage extending from the atomizing gas inlet end portion to the atomizing gas discharge end portion, and (c) a spray tip having an inlet end portion and a discharge end portion, the inlet end portion of the spray tip joined to the atomizing gas discharge end portion of the outer conduit. The spray tip has (i) a mixing chamber disposed to receive a liquid fuel from the liquid fuel discharge end portion of the inner conduit and disposed to receive an atomizing gas from the atomizing gas discharge end portion of the atomizing gas passage, and (ii) an orifice at the outlet end portion of the spray tip, the orifice disposed to receive the liquid fuel and the atomizing gas from the mixing chamber and for discharging the liquid fuel and the atomizing gas from the spray tip as an atomized liquid fuel into the first oxidant gas stream. The inner conduit has a plurality of external fins at the liquid fuel discharge end portion of the inner conduit wherein at least some of the plurality of external fins contact an inner surface of the inlet end portion of the spray tip. The method further comprises (B) passing a first oxidant gas through the first oxidant gas passage thereby discharging the first oxidant gas stream from the first oxidant gas passage discharge end portion, (C) passing the liquid fuel through the inner conduit and into the mixing chamber and passing the atomizing gas through the atomizing gas passage and into the mixing chamber thereby forming a mixture of the liquid fuel and the atomizing gas, (D) passing the mixture of the liquid fuel and the atomizing gas through the orifice thereby discharging the mixture of the liquid fuel and the atomizing gas from the mixing chamber as an atomized liquid fuel into the first oxidant gas stream, and (E) combusting at least a portion of the atomized liquid fuel with at least a portion of the first oxidant gas stream thereby forming a flame.

The burner used in the method may further comprise a second oxidant gas conduit section defining a second oxidant gas passage. The second oxidant gas passage may be proximate and above or below the first oxidant gas passage. The second oxidant gas passage is for discharging a second oxidant gas stream. The method may further comprise passing the second oxidant gas stream through the second oxidant gas passage thereby discharging the second oxidant gas stream below the flame, and combusting at least another portion of the liquid fuel with at least a portion of the second oxidant gas stream.

In the method, the mixture of the liquid fuel and the atomizing gas may have a mean residence time in the mixing chamber of from 70 to 3200 microseconds, from 160 to 2400 microseconds, or from 250 to 1600 microseconds.

In the method, the mixture of the liquid fuel and the atomizing gas may be discharged from the spray tip with a velocity, $v_1$, and the first oxidant gas may be discharged from the first oxidant gas conduit discharge end portion with a velocity, $v_2$, wherein $$1 \leq \frac{v_1}{v_2} \leq 100.$$

DETAILED DESCRIPTION

The articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

The phrase "at least a portion" means "a portion or all."

In one aspect, the present disclosure relates to an apparatus for combustion of a liquid fuel. The apparatus may be a liquid fuel atomizer suitable for use in a burner.

Figure 1:
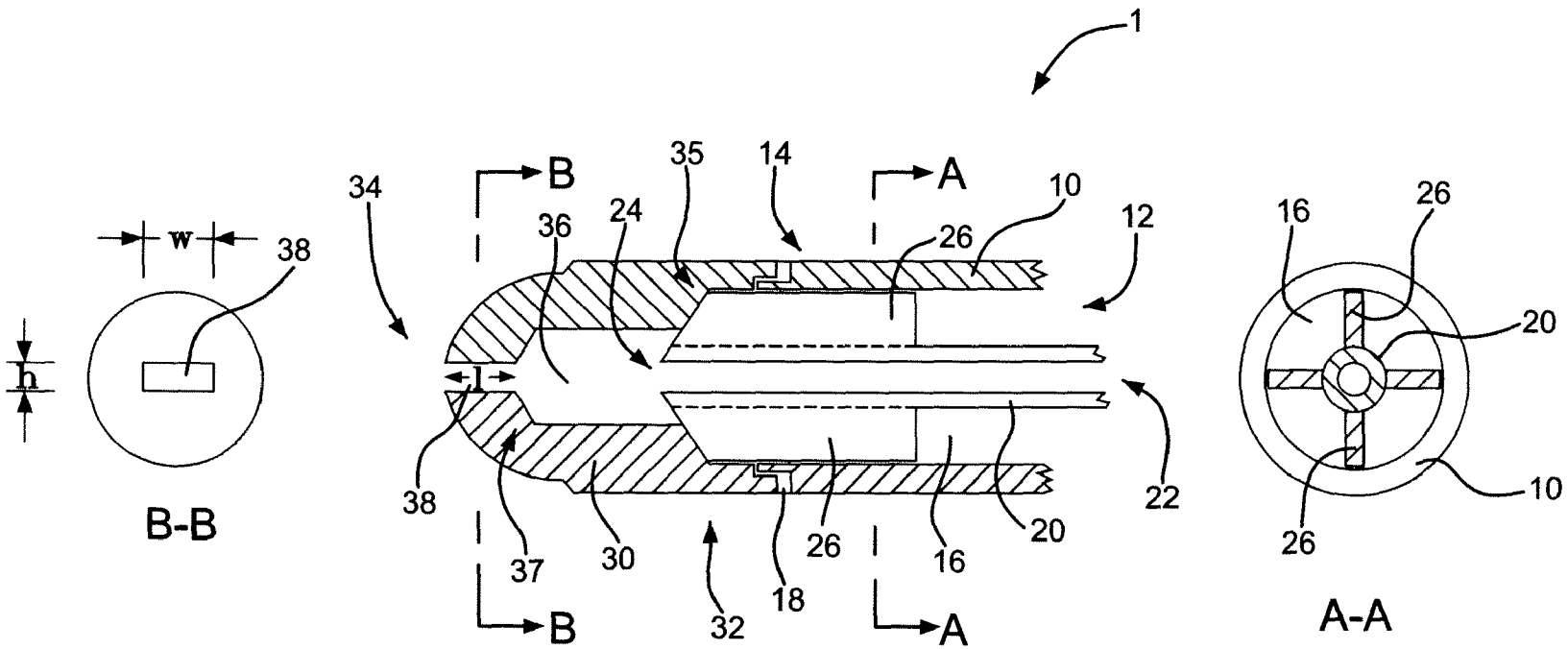
FIG. 1 is a cross sectional view of a liquid fuel atomizer with external fins on the inner conduit where the external fins are tapered over a portion of the external fins.

With reference to FIG. 1, the liquid fuel atomizer 1 comprises an outer conduit 10 of generally cylindrical shape having an atomizing gas inlet end portion 12 and an atomizing gas discharge end portion 14. The liquid fuel atomizer 1 also comprises an inner conduit 20 of generally cylindrical shape having a liquid fuel inlet end portion 22 and a liquid fuel discharge end portion 24. The inner conduit 20 is disposed within the outer conduit 10 and forms an atomizing gas passage 16 between the outer conduit 10 and the inner conduit 20. The atomizing gas passage 16 extends from the atomizing gas inlet end portion 12 to the atomizing gas discharge end portion 14. Since the article "a" means one or more when applied to the passage feature, one or more passages may be formed between the outer conduit 10 and the inner conduit 20. Furthermore, the passage 16 may be divided and/or divided and recombined as it extends from the atomizing gas inlet end portion 12 and the atomizing gas discharge end portion 14, but nevertheless provides a continuous flow path from the atomizing gas inlet end portion 12 to the atomizing gas discharge end portion.

The ratio of the conduit wall thickness to the outer diameter of the outer conduit 10 may be from 0.034 to 0.35 or from 0.1 to 0.2, or from 0.14 to 0.18. The benefit of the ratio of the conduit wall thickness to the outer diameter of the outer conduit of from 0.1 to 0.2 when compared to smaller ratios is two-fold. First, it provides an increased cross sectional area for heat to be conducted away from the hot spot located on the outside surface of the liquid fuel atomizer 1, which is typically located somewhere between the discharge end portion 34 of the spray tip 30 and three outer conduit 10 diameters upstream. Secondly, it allows for a thicker joint through the wall thickness of the outer conduit 10 which provides an increased cross sectional area for heat to be conducted away from the hot spot located on the outside surface of the liquid fuel atomizer 1.

The outer conduit 10 may have a first longitudinal axis and the inner conduit 20 may have a second longitudinal axis wherein the first longitudinal axis and the second longitudinal axis are substantially coaxial. Substantially coaxial means that the axes are coincident, parallel and within 5% of the inner conduit inner diameter of being coincident, or slightly askew where the axes are parallel to within 2° and within 5% of the inner conduit inner diameter at the atomizing gas discharge end portion 14 and liquid fuel discharge end portion 24.

The inner conduit 20 has an effective inner diameter measured on the inside of the conduit 20 near or at the outlet end of the conduit 20 that is adjacent to the mixing chamber 36. In case of a circular conduit cross section, the effective diameter is the same as the diameter. In case of a slightly out-of-round or non-circular conduits, an effective diameter can be calculated, the effective diameter giving the same cross-sectional area as the cross sectional area of the non-circular conduit. The effective inner diameter of the inner conduit 20 may be from 1.27 mm to 12.7 mm.

The liquid fuel atomizer 1 also comprises a spray tip 30 having an inlet end portion 32 and a discharge end portion 34. The inlet end portion 32 of the spray tip 30 is joined to the atomizing gas discharge end portion 14 of the outer conduit 10 by a join 18. The join 18 may be a weld joint, press fit join, threaded joint or other suitable join known in the art. The join 18 is preferably a weld joint. A weld joint may provide better heat conduction for cooling the spray tip. The weld joint may have a thickness of greater than 50% to 100% of the wall thickness of the outer conduit 10. It may be desirable to make the weld joint as thick as practical. Large weld joints require that the thickness of one of the outer conduit and the spray tip at the overlap region be thin and therefore more prone to deformation during welding, which is not desirable.

The inner conduit may be removably connected to the outer conduit at the inlet end portion by a threaded or other suitable connection (not shown) which permits removal of the inner conduit from the liquid fuel atomizer for cleaning.

The spray tip 30 has a mixing chamber 36 disposed to receive a liquid fuel from the liquid fuel discharge end portion 24 of the inner conduit 20 and disposed to receive an atomizing gas from the atomizing gas passage 16. The mixing chamber 36 is intermediate the inlet end portion 32 and the discharge end portion 34. The spray tip 30 also has an orifice 38 at the discharge end portion 34 of the spray tip 30. The orifice 38 is disposed to receive the liquid fuel and the atomizing gas from the mixing chamber 36 and for discharging the liquid fuel and the atomizing gas from the spray tip 30 as an atomized liquid fuel.

The mixing chamber 36 has an effective diameter and a length. The length of the mixing chamber is measured from the outlet end of the inner conduit 20 to the chamber-side of the mixing chamber orifice 38. Although the mixing chamber 36 is shown as cylindrical, it is not limited to a cylindrical shape and/or circular cross section. In case the cross section of the mixing chamber is circular, the effective diameter is the same as the diameter. In case the cross section of the mixing chamber is non-circular, an effective diameter can be calculated, said effective diameter giving the same cross sectional area. The mixing chamber 36 has a length that is 2 times or less than 2 times of the effective inner diameter of the inner conduit 20. The length of the mixing chamber may be from 0.5 to 2 times greater than the effective inner diameter of the inner conduit 20 for sufficient mixing of the atomizing gas and liquid fuel prior to being discharged through the flame-shaping orifice 38. Alternatively, the mixing chamber length may be from 1 to 2 times, or about 1.7 times the effective inner diameter of the inner conduit 20. For the design firing rates, the liquid fuel and the atomizing gas should remain in the mixing chamber for a mean residence time from 70 to 3200 microseconds, from 160 to 2400 microseconds, or from 250 to 1600 microseconds. When the liquid fuel and atomizing gas are provided an opportunity to mix in the emulsion chamber, the coke build up is decreased and the maintenance to clean the nozzle is reduced.

As shown in FIG. 1, the mixing chamber may have a converging internal taper 37 which converges in the direction of the orifice 38. A converging internal taper provides a benefit of easier cleaning. A cleaning tool shaped like the end of a drill bit with complementary shape to the converging internal taper may be used to clean the spray tip. Alternatively, the mixing chamber may have a tapered portion located towards the orifice, which is spherical-shaped, or elliptical-shaped, or the like and may extend over more or less of the length of the mixing chamber than as shown. Although the emulsion chamber is shown with a constant cross-section over a majority of the mixing chamber in FIG. 1, the mixing chamber is not limited to a constant cross-section. In alternative embodiments, the mixing chamber may be shaped to reduce in cross-section over a majority or all of its length from the fuel inlet to the orifice, thereby providing a tapered mixing chamber.

The inner conduit 20 has a plurality of external fins 26 at the liquid fuel discharge end portion 24 of the inner conduit 20 wherein at least some of the plurality of external fins 26 contact an inner surface 35 of the inlet end portion 32 of the spray tip 30. All of the plurality of external fins 26 may contact the inner surface 35 of the inlet end portion 32 of the spray tip 30. External fins are outward protrusions which define grooves on the outer surface of the inner conduit 20. The external fins 26 contacting the inner surface of the spray tip has the benefit of providing an additional heat conduction path from the spray tip and setting the prescribed gap between the liquid fuel discharge end portion 24 of the inner conduit 20 and the inlet end portion 32 of the spray tip 30 for the atomizing gas passage 16. The gap is set by the external fins and is not adjustable, except by modifying the external fins.

The plurality of external fins 26 may number from 3 to 20 or from 6 to 10. The plurality of external fins 26 may be longitudinal fins, where the fins are straight and have an axis which is parallel to the longitudinal axis of the inner conduit 20. Alternatively, the plurality of external fins 26 may be spiral or helical as they move down the length of the inner conduit. The external fins may also be straight for a portion and spiral or helical near the outlet end portion 24 of the inner conduit 20.

Figure 2:
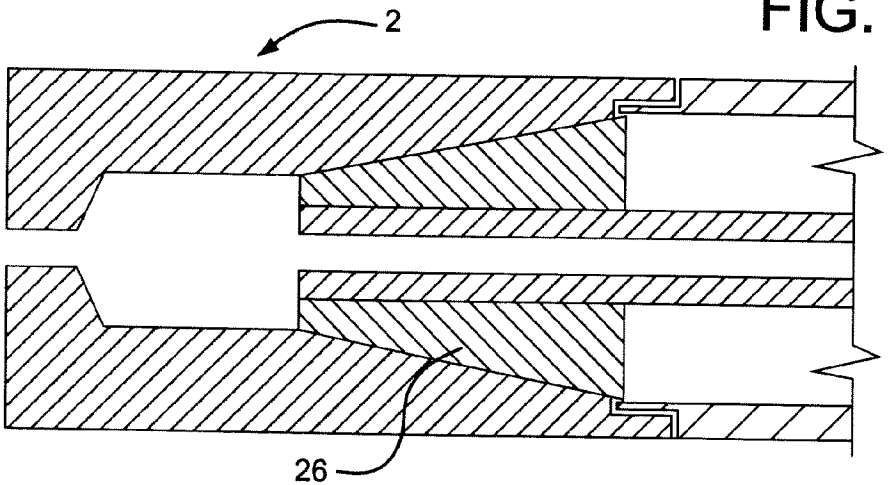
FIG. 2 is a cross sectional view of a liquid fuel atomizer with external fins on the inner conduit where the external fins are tapered over the entire length of the external fins.

As shown in FIG. 1, the plurality of external fins 26 may have a converging external taper which converges in the direction of the liquid fuel discharge end portion 24. Further, as shown in FIG. 1, the spray tip 30 may have a converging internal taper at the inlet end portion 32 which converges in the direction of the discharge end portion 34. The internal taper of the spray tip 30 may be generally complementary to the external taper of the plurality of external fins 26. The converging external taper may be over part of the length of the plurality of external fins 26. Alternatively, as shown for the liquid fuel atomizer 2 in FIG. 2, the converging external taper may be over all of the length of the plurality of external fins 26.

Figure 3:
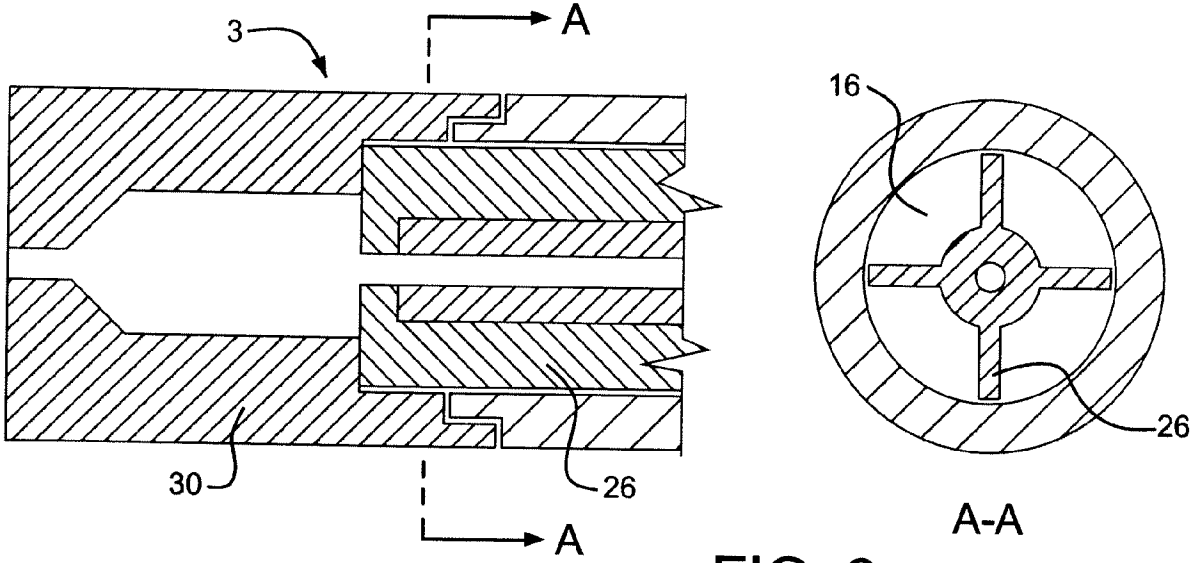
FIG. 3 is a cross sectional view of a liquid fuel atomizer with external fins on the inner conduit where the external fins are not tapered.

As shown for the liquid fuel atomizer 3 in FIG. 3, the plurality of external fins 26 may be without a converging external taper. The spray tip 30, too, may be without a converging internal taper at the inlet end portion 32.

The liquid fuel atomizer may be used to atomize any liquid fuel used in industrial furnace applications, for example, No. 1 distillate oil, No. 2 distillate fuel oil, diesel fuel, biodiesel and it's by-products (such as glycerol), kerosene, No. 4 fuel oil, No. 5 residual oil, No. 6 residual fuel oil, Bunker-C type fuel oil and others known to a person of ordinary skill in the art. The atomizing gas may be any known atomizing gas used in industrial furnace applications, for example, air, natural gas, industrial grade oxygen, oxygen-enriched air, propane, nitrogen, carbon dioxide, hydrogen, or a mixture of two or more of these gases.

For some furnace applications, such as glass melting furnaces, generally flat flames may be preferred. To generate a generally flat flame, the orifice 38 may be an elongated slotted orifice, which acts to form a flattened spray pattern. A slotted orifice is a slot opening having a width dimension and a height dimension, where the width dimension is greater than the height dimension. The width may range from 3 mm to 25.4 mm and the height may range from 0.75 to 7.62 mm. The slot cross-section may be rectangular, oval, or other suitable non-circular shape. An elongated slotted orifice has a length dimension as well, where the length dimension is at least 2 times the hydraulic diameter. The length dimension may be 2 to 10 times the hydraulic diameter. The cross-section of the slot may vary along the length, for example, the width dimension may increase in the direction of flow thereby having a divergence angle. A length dimension greater than 2 times the hydraulic diameter allows the spray pattern to be shaped by the orifice shape and divergence angle. The hydraulic diameter, $D_H$, is defined in the conventional way, $$D_H = \frac{4 \times \text{cross} - \text{sectional area}}{\text{wetted perimeter}}.$$

In case the hydraulic diameter varies along the length of the elongated slot, the required diameter dimension is taken at the orifice inlet plane.

The outer conduit 10, inner conduit 20, and spray tip 30 can be made from any suitable material, for example, stainless steel and constructed using methods known in the art. The plurality of external fins 26 may be machined into the surface of the inner conduit 20 by cutting grooves into the outer surface.

The apparatus for combustion of a liquid fuel may be a burner with the liquid fuel atomizer as described above. The burner may be adapted to operate at a firing rate of between 0.10 and 12 MW or between 0.25 and 6 MW.

Figure 4:
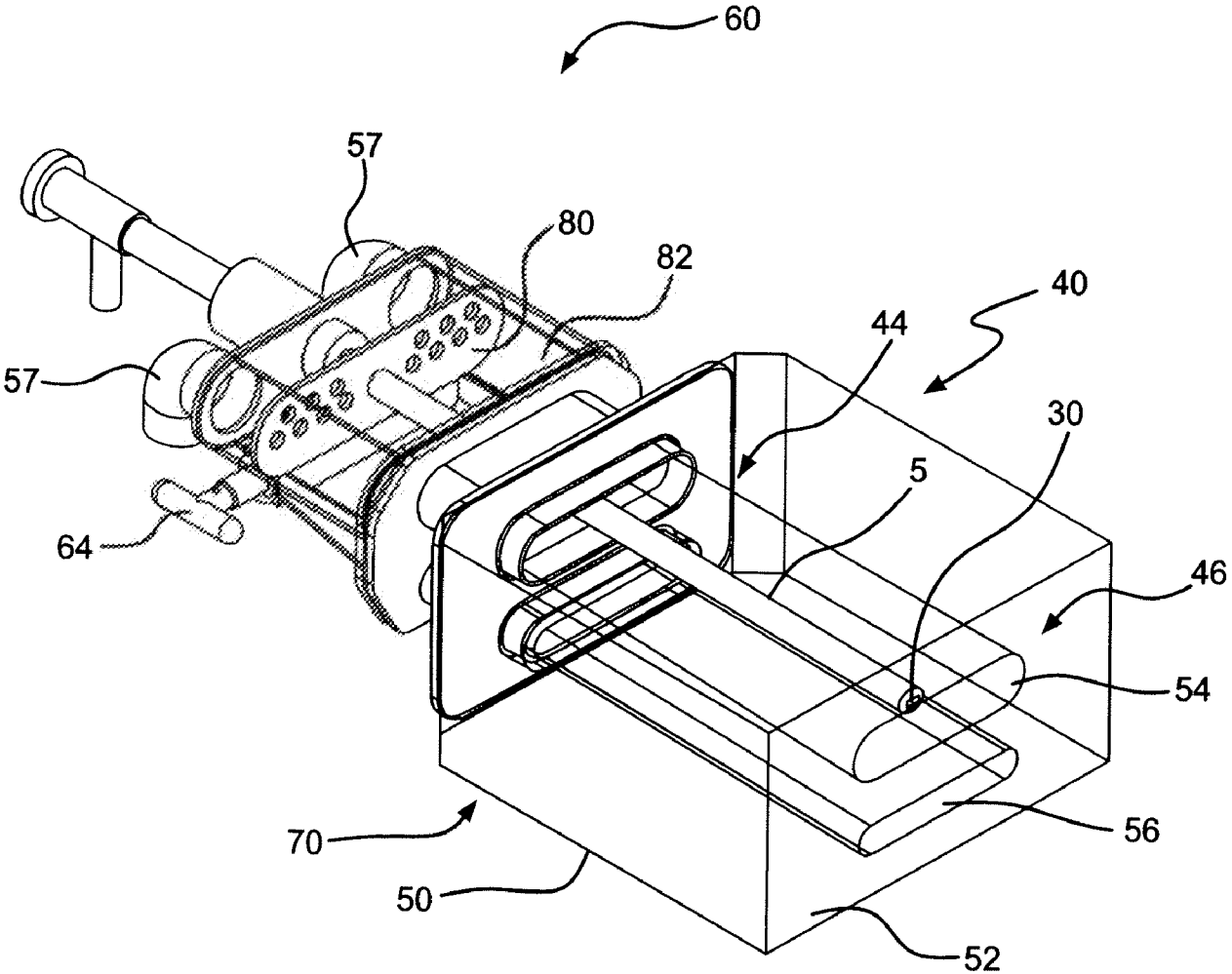
FIG. 4 shows a perspective view of a burner that incorporates the liquid fuel atomizer.

With reference to FIG. 4, the burner 60 comprises a first oxidant gas conduit section 40 defining a first oxidant gas passage 54, the first oxidant gas passage 54 having a first oxidant gas passage inlet end portion 44 and a first oxidant gas passage discharge end portion 46 for discharging a first oxidant gas stream, and a liquid fuel atomizer 5 disposed in spaced relation to the oxidant gas conduit section 40 with at least part of the liquid fuel atomizer 5 disposed within the first oxidant gas passage 54.

The liquid fuel atomizer 5 is as described above and may comprise any of the liquid fuel atomizer features described herein.

The first oxidant gas may be any oxidant gas suitable for combustion, for example, air, oxygen-enriched air, and industrial grade oxygen.

The first oxidant gas passage 54 may have a cross-sectional shape with a width and height of different dimensions. The first oxidant gas passage 54 may have a width to height ratio of 5 to 30. The first oxidant gas passage 54 may have a cross section of non-circular shape and each cross section may be characterized by a center point or centroid, where centroid has the usual geometric definition. The gas passage 54 may be further characterized by a longitudinal axis defined as a straight line orthogonal to the passage cross sections and connecting the centroids of the passage cross sections.

The burner 60 may further comprise a second oxidant gas conduit section 70 defining a second oxidant gas passage 56 for discharging a second oxidant gas stream for so-called oxidant staging. The second oxidant gas passage 56 is proximate the first oxidant gas passage 54 and may be located below the first oxidant gas passage 54. The second oxidant gas passage 56 may have a cross-sectional shape with a width and height of different dimensions. The second oxidant gas passage 56 may have a width to height ratio of 5 to 30. The second oxidant gas passage 56 may have a cross section of non-circular shape and each cross section may be characterized by a center point or centroid, where centroid has the usual geometric definition. The second oxidant gas passage 56 may be further characterized by a longitudinal axis defined as a straight line orthogonal to the passage cross sections and connecting the centroids of the passage cross sections. The longitudinal axis of the first oxidant gas passage 54 and the longitudinal axis of the second oxidant gas passage 56 may be substantially parallel.

The second oxidant gas may be any oxidant gas suitable for combustion, for example, air, oxygen-enriched air, and industrial grade oxygen. The first oxidant gas and the second oxidant gas may be the same composition, coming from the same source.

The first oxidant gas conduit section 40 and the second oxidant gas conduit section 70 may be constructed from separate and distinct conduits or constructed from a single block of material, e.g. a burner block, as shown in FIG. 4. FIG. 4 shows the first oxidant gas passage 54 and the second oxidant gas passage 56 formed in a common burner block 50. As shown in FIG. 4, the burner block 50 may comprise the first oxidant gas conduit section 40 and the second oxidant gas conduit section 70.

The burner may be constructed to convey the same oxidant gas to the first oxidant gas passage 54 and the second oxidant gas passage 56 so that the second oxidant gas stream has the same concentration of oxygen as the first oxidant gas stream. Alternatively, the burner may be constructed to convey a different oxidant gas to the second oxidant gas passage 56 than to the first oxidant gas passage 54 so that the second oxidant gas stream has a different concentration of oxygen than the first oxidant gas stream.

As shown in FIG. 4, the burner 60 may further comprise an oxidant inlet manifold 57. Oxidant gas flows through the oxidant inlet manifold 57 and eventually to the first oxidant gas passage 54 and the second oxidant gas passage 56. The oxidant inlet manifold 57 is in upstream fluid flow communication with the first oxidant gas passage 54 and the second oxidant gas passage 56. A staging valve 64 may be used to divert or regulate the flow of the oxidant gas to the second oxidant gas passage 56. The staging valve 64 is in downstream fluid flow communication with the oxidant inlet manifold 57 and in upstream fluid flow communication with the first and second oxidant gas passage 56.

The burner 60 may further comprise an oxidant inlet plenum 82 in upstream fluid flow communication of the first oxidant gas passage 54. The oxidant inlet plenum may be spaced around at least a portion of the liquid fuel atomizer, and at least a portion of the first oxidant gas passage 54 may be spaced around the spray tip. The burner may further comprise a diffuser 80 located upstream of the oxidant plenum 82. The purpose of this diffuser is to assist in distributing the oxidant flow entering the oxidant inlet plenum.

The discharge end of the spray tip 30 may be mounted flush with the hot face 52 of the burner block 50, or recessed inside of the first oxidant gas passage 54. Recessing the spray tip 30 into the burner block 50 will help to maintain cooler operating temperature of the mixing chamber. However, the extent to which the spray tip 30 may be recessed will depend on the operating conditions of the burner 60, as described below.

In another aspect, the present disclosure relates to a method for combusting a liquid fuel using the burner as described herein. In the method, the burner may be operated at a firing rate of between 0.10 and 12 MW or between 0.25 and 6 MW.

The method for combusting a liquid fuel comprises providing a burner as described herein with a liquid fuel atomizer as described herein. The burner and liquid fuel atomizer may comprise any of the respective burner or liquid fuel atomizer features described herein.

With reference to FIG. 1 and FIG. 4, the method comprises passing a first oxidant gas through the first oxidant gas conduit section 40 thereby discharging a first oxidant gas stream from the first oxidant gas conduit discharge end portion 46. The method further comprises passing the liquid fuel through the inner conduit 20 and into the mixing chamber 36 and passing the atomizing gas through the atomizing gas passage 16 and into the mixing chamber 36 thereby forming a mixture of the liquid fuel and the atomizing gas. The method then further comprises passing the mixture of the liquid fuel and the atomizing gas through the orifice 38 thereby discharging the mixture of the liquid fuel and the atomizing gas from the mixing chamber 36 as an atomized liquid fuel into the first oxidant gas stream. The method further comprises combusting at least a portion of the liquid fuel with at least a portion of the first oxidant gas stream thereby forming a flame.

The method may also include oxidant staging. A second oxidant gas may be passed through a second oxidant passage 56 thereby discharging the second oxidant gas stream below the flame and combusting at least a portion of the liquid fuel with at least a portion of the second oxidant gas stream.

In the method, the mixture of the liquid fuel and the atomizing gas may have a mean residence time in the mixing chamber of from 70 to 3200 microseconds, from 160 to 2400 microseconds, or from 250 to 1600 microseconds.

The mean residence time is calculated by dividing the overall mixing chamber volume (over the emulsion chamber length defined earlier) by the emulsion mixture volumetric flow rate. The emulsion mixture volumetric flow rate is calculated by adding the volumetric flow rates of both the liquid fuel and atomizing gas. Since the atomizing gas is compressible, the actual volumetric flow rate for the gas is obtained by correcting for pressure. For example, if the liquid fuel flow rate is 70 liters/hour, the atomizing gas flow rate is 11 normal meters cubed per hour ($Nm^3/h$), the pressure in the emulsion chamber is 2.4 bar, and the temperature in the mixing chamber is 373K, the emulsion mixture volume rate is:

$$\left(\frac{70\ \text{l/h}}{1000\ \text{l/m}^3} + \frac{(11\ \text{Nm}^3/\text{h}(1.01325\ \text{bar})}{2.4\ \text{bar}} \times \frac{373\ \text{K}}{273.15\ \text{K}}\right) \times \frac{\text{h}}{3600\ \text{s}} = 0.0018\ \text{m}^3/\text{s}.$$

For a nozzle having an emulsion chamber volume of 790 $mm^3$, the mean residence time is: $790\ mm^3 \times 1/(0.0018\ m^3/s) \times m^3/1\times10^9\ mm^3 = 443\ \mu s$.

In the method, the mixture of the liquid fuel and the atomizing gas may be discharged from the spray tip with a velocity, $v_1$, and the first oxidant gas may be discharged from the first oxidant gas conduit discharge end portion with a velocity, $v_2$, wherein $$1 \le \frac{v_1}{v_2} \le 100.$$

Operating in this range provides the benefit of maintaining the correct flame shape. In liquid fuel combustion, the flame shape is dictated primarily by the region emanating from the spray tip which contains fuel droplets. For combustion to occur, the fuel droplets first evaporate and it is the evaporation of the droplet (prior to combustion) which is the rate limiting step in the combustion process which proceeds as a diffusion flame around the evaporating drop (Lefebvre, "Atomization and Sprays," p. 309, Hemisphere Publishing, 1989). By keeping the mixture of the liquid fuel and the atomizing gas velocity, $v_1$, greater than the first oxidant gas velocity, $v_2$, the mixture of the liquid fuel and the atomizing gas will tend to draw the first oxidant gas into the region containing the liquid fuel droplets without significantly affecting the shape of the region containing the liquid fuel droplets. In this way the flame shape is not significantly affected by the flow of oxidant gas, but is instead dictated more by the design of the liquid fuel atomizer. In other words, the flame envelope is a strong function of the spray pattern of the atomizer.

Once the ratio $$\frac{v_1}{v_2}$$

increases beyond 100, either the atomizing gas velocity, $v_1$, is very large, or the first oxidant gas velocity, $v_2$, is very small, or both. When the mixture of the liquid fuel and the atomizing gas velocity, $v_1$, is very large, this has the disadvantage of requiring high supply pressures of the atomizing gas and liquid fuel. When the first oxidant gas velocity, $v_2$, is very small, this has the affect of reducing the extent to which the first oxidant gas will provide beneficial cooling to the spray tip, and may result in uneven distribution of the first oxidant gas around the spray tip, 30, and outer conduit, 10. For this reason a ratio $$\frac{v_1}{v_2}$$

above 100 is not desirable.

If the first oxidant gas velocity, $v_2$, is greater than the mixture of the liquid fuel and the atomizing gas velocity, $v_1$, then the region containing liquid fuel droplets, and therefore the flame, begins to change shape and in some instances will oscillate. This increases the likelihood of having the region of liquid fuel droplets, and therefore the flame, impinge on the inside surface of the first oxidant gas passage, 54, of the burner block, 50, resulting in damage to the burner block, 50. In addition, this will significantly restrict the extent to which the lance can be recessed inside the of the burner block.

The mixture velocity, $v_1$, is calculated by adding the volumetric flow rates of both the liquid fuel and atomizing gas and dividing the result by the cross sectional area of the orifice. As described earlier, since the atomizing gas is compressible, the actual volumetric flow rate for the gas is obtained by correcting for pressure. For example, if the liquid fuel flow rate is 70 liters/hour, the atomizing gas flow rate is 11 $Nm^3/h$, the pressure in the mixing chamber is 2.4 bar, the temperature in the mixing chamber is 373K, and the cross sectional area of the orifice is 30 $mm^2$, the mixture velocity is:

$$\left(\frac{70\ \text{l/h}}{1000\ \text{l/m}^3} + \frac{(11\ \text{Nm}^3/\text{h}(1.01325\ \text{bar})}{2.4\ \text{bar}} \times \frac{373\ \text{K}}{273.15\ \text{K}}\right) \times$$

-continued $$\frac{h}{3600} \times \frac{1E6\ mm^2}{m^2} \Big/ 30\ mm^2 = 59.4\ m/s.$$

It the area of the orifice varies over its length, the smallest area is used for the calculation of the mixture velocity.

EXAMPLES

Computational fluid dynamics (CFD) simulations were carried out to determine the effect of changing several factors in the geometry of the liquid fuel atomizer. In all of the CFD examples that follow, the atomizing nozzle was located in the center of the first oxidant gas passage as shown in FIG. 4. The geometric parameters of the burner are summarized in Table 1. The depth of the block was long enough to ensure fully developed flow of oxidant in both the first and second oxidant gas passages.

TABLE 1

| Item | Value | Unit |
|---|---|---|
| First oxidant gas passage (54) width | 288 | mm |
| First oxidant gas passage (54) height | 53 | mm |
| Outside diameter of outer conduit (10) | 26 | mm |
| Orifice (38) area | 18.7 | $mm^2$ |

Example 1

Effect of Operating Conditions

In Example 1, the effect of changing the operating conditions on the mixing chamber maximum temperature was determined, using the nozzles of Cases 1 and 2 as described in Table 3. Two operating conditions were chosen. In the first operating condition, the oil flow to the burner was 106 l/hr and the atomizing flow was 3.94 $Nm^3$/hr. The proportion of oxidant through first oxidant passage was 30%, with the balance of oxidant required for stoichiometric combustion flowing through the second oxidant gas passage. In the second operating condition, the oil flow to the burner was 265 l/hr and the atomizing flow was 3.94 $Nm^3$/hr. The proportion of oxidant through first oxidant passage was 50%, with the balance of oxidant required for stoichiometric combustion flowing through the second oxidant gas passage. The furnace temperature for both cases was 1649° C.

For Case 1, under these two sets of operating conditions, the maximum predicted temperature inside of the mixing chamber was 532° C. for the lower oil flow rate and lower oxidant flow rate in the first oxidant gas passage. The maximum predicted temperature inside of the mixing chamber was 377° C. for the higher oil flow rate and higher proportion of oxidant flow rate in the first oxidant gas passage.

For Case 2, under these two sets of operating conditions, the maximum predicted temperature inside of the mixing chamber was 433° C. for the lower oil flow rate and lower oxidant flow rate in the first oxidant gas passage. The maximum predicted temperature inside of the mixing chamber was 306° C. for the higher oil flow rate and higher proportion of oxidant flow rate in the first oxidant gas passage.

Decreasing the maximum mixing chamber temperature lowers the propensity for asphaltenes in the fuel oil (particularly heavy fuel oil) to form coke, which in turn lowers the frequency required to clean the nozzle assembly. And while it is tempting to say that it is merely a matter of altering the operating conditions of the burner (i.e. by increasing the proportion of oxidant to the first oxidant passage) and atomizer (i.e. by increasing the oil and atomizing gas flow) to ensure that the mixing chamber temperature is sufficiently decreased to an acceptable level, it is typically the operation of the furnace that dictates the oil flow rate, and by extension the oxidant flow rate, to the burner, and not the other way around. In addition the most optimal operation, particularly for glass melting, is typically with maximum degree of oxidant staging possible (i.e. with a greater proportion of oxidant directed to the second oxidant passage), with the benefits of increased direction radiation (more heat from the flame directed downward toward the glass, less heat directed from the flame toward the crown of the furnace), glass quality, and decreased NOx emissions as described, for example, in U.S. Pat. No. 7,390,189. Finally, it is preferable to have an atomizer in the burner which has the capability to cover a wide range of operating conditions. This gives the greatest flexibility of furnace operation without having to exchange equipment to match the required burner operating conditions, such as firing rate or oil flow rate, and proportion of oxidant flow through the first oxidant passage.

For these reasons it is desirable to lower the mixing chamber temperature to the greatest extent possible, for a given set of operating conditions. Therefore, the operating conditions were arbitrarily fixed, as summarized in Table 2, so that the examples that follow can illustrate how different configurations of the instant invention lower the maximum mixing chamber temperature.

TABLE 2

| | |
|---|---|
| Oil Flow | 265 l/hr |
| Atomizing gas flow | 3.94 $Nm^3$/hr |
| Proportion of oxidant through first oxidant passage | 50% |
| Furnace temperature | 1649° C. |
| Oxygen purity | 100% |
| Oil inlet temperature | 117° C. |
| Atomizing gas inlet temperature | 27° C. |

The effects of the following features, as summarized in Table 3, on the maximum mixing chamber temperature were investigated:

1. Contact of the plurality of external fins to the inner surface of the inlet end portion of the spray tip
2. The weld joint thickness as a proportion of the wall thickness of the outer conduit
3. The ratio of conduit wall thickness to outer conduit outer diameter; and
4. Geometry of the atomizing gas passage (hydraulic diameter).

TABLE 3

| Case | 1 | 2 | 3 | 4 | 5 |
|---|---|---|---|---|---|
| Contact area/outer conduit wall cross sectional area | 0 | 1.09 | 1.09 | 1.02 | 1.5 |
| Weld thickness (% of wall thickness) | 25 | 25 | 100 | 100 | 100 |

TABLE 3-continued

| Case | 1 | 2 | 3 | 4 | 5 |
|---|---|---|---|---|---|
| Ratio of outer conduit wall thickness to outer conduit outer diameter | 0.147 | 0.147 | 0.147 | 0.147 | 0.108 |
| Ratio of inner conduit wall thickness to inner conduit outer diameter in the region of the external fins | 0.605 | 0.509 | 0.509 | 0.522 | 0.416 |
| Ratio of length of external fins to outer diameter of outer conduit | 0 | 2.23 | 2.23 | 0.49 | 2.23 |
| Ratio of (number of fins, N x mean fin arc length, S) to inner perimeter of outer conduit, P, in the region of the external fins to the inner surface area of the outer conduit | 0 | 0.524 | 0.524 | 0.379 | 0.572 |
| (Atomizing gas passage hydraulic diameter)/(Outer diameter of outer conduit) at atomizing gas discharge end portion | 0.116 | 0.064 | 0.064 | 0.056 | 0.061 |
| (Atomizing gas passage hydraulic diameter)/(Outer diameter of outer conduit) at atomizing gas inlet end portion | 0.117 | 0.238 | 0.238 | 0.109 | 0.210 |
| Atomizing gas passage geometry at spray tip inlet end portion | 8 holes | 8 square grooves | 8 square grooves | 8 square grooves | 8 square grooves |
| Maximum mixing chamber temperature (° C.) | 377 | 306 | 313 | 288 | 306 |
| Maximum outer conduit temperature (° C.) | 383 | 511 | 479 | 372 | 487 |

Example 2

Effect of Contact of the Plurality of External Fins to the Inner Surface of the Inlet End Portion of the Spray Tip In this comparison, between Case 1 and Case 2 of Table 3, the maximum predicted temperature inside of the mixing chamber was 377° C. when there was no contact between the inlet end portion of the spray tip, whereas the temperature was 306° C. when there was contact with the inlet end portion of the spray tip.

Pyrolysis of asphaltenes (a significant component of residual fuel oils), which among other things produces coke, occurs between 350° C. and 800° C. (Speight, James G. Handbook of Petroleum Analysis. (p: 216). John Wiley & Sons© 2001) and to avoid the possibility of coke formation, it is necessary to keep the mixing chamber temperature (the hottest portion of the atomizing assembly that is in contact with the oil) below 350° C. Therefore it can be seen that by having contact of the plurality of external fins to the inner surface of the inlet end portion of the spray tip lowers the maximum temperature of the mixing chamber below 350° C., the temperature at which asphaltenes start to form coke. While it is tempting to say that the problem is now solved and no further improvement is necessary, it is important to note that by lowering the maximum mixing chamber temperature further will result in a larger window of operating conditions in which the propensity for coke formation is eliminated or significantly reduce.

Example 3

Effect of the Weld Joint Thickness as a Proportion of the Wall Thickness of the Outer Conduit Another study was carried out to explore other possibilities of further decreasing the chamber temperature. In this comparison, between Case 2 and Case 3 of Table 3, the maximum predicted temperature inside of the mixing chamber was 306° C. when the weld joint thickness was 20% of the wall thickness of the outer conduit, whereas the temperature was 313° C. when the weld joint thickness was 100% of the wall thickness of the outer conduit. This slight increase in temperature is an unexpected result, and further analysis reveals that reason for this is due to a complex interaction of the many modes of heat transfer in this system.

Besides the spray tip, the outer conduit also receives a significant portion of heat via radiant heat transfer from the furnace to its outer surface. In general, heat is removed from the outer conduit by several mechanisms: heat convection via flow of the oxidant through the first oxidant passage, which surrounds the outer conduit; heat conduction along the length of the outer conduit, as well as radial conduction through the conduit wall; heat convection via flow of the atomizing gas which is in fluid communication with the inner surface of the outer conduit. The convection always helps to cool the chamber temperature, but whether the conduction along the length of the outer conduit would do the same depends on which direction the heat is conducted. In this example, the spray tip is effectively cooled by the liquid fuel and atomizing gas at the inner surface of the emulsion chamber, and the hottest spot occurs at the outer surface of the outer conduit (10) instead of at the nozzle tip. The contact between the plurality of external fins and the inner surface of the inlet end portion of the spray tip further decreases the tip temperature.

While heat will be conducted away from the hottest part of the outer conduit in both directions (toward the spray tip and away from the spray tip to the back of the burner which is located outside of the furnace behind a refractory block) the magnitude of the heat conduction toward the spray tip is greater than the heat conduction away from the spray tip because the temperature gradient is larger as a result of the cooling effect of the liquid fuel on the spray tip and the relatively short distance between the spray tip and outer conduit hot spot.

The reason that the maximum mixing chamber temperature is increased when the thickness of the weld is increased is because the thicker welds allows for a greater amount of heat to be conducted axially along the outer conduit wall from the conduit wall hot spot to the spray tip and into the mixing chamber.

It is important to note that despite the slight increase in mixing chamber maximum temperature, the maximum temperature of the outer conduit decreased from 511° C. to 479° C.

Example 4

Effect of the Ratio of Conduit Wall Thickness to Outer Conduit Outer Diameter

In this comparison, between Case 3 and Case 5 of Table 3, the maximum predicted temperature inside of the mixing chamber was 313° C. when the ratio of outer conduit wall thickness to outer conduit outer diameter was 0.147, whereas the temperature was 306° C. when the ratio of outer conduit wall thickness to outer conduit outer diameter was 0.108. As expected from the weld thickness comparative example above, the emulsion chamber temperature is slightly cooler when the wall thickness is thinner. However, less heat is conducted along the length of the outer conduit from the hot spot to the spray tip, resulting in an increase in maximum outer conduit temperature from 479° C. to 487° C.

Example 5

Effect of Geometry of the Atomizing Gas Passage(s) (Hydraulic Diameter)

In this comparison, between Case 3 and Case 4 of Table 3, the first change that was made was that the length of the plurality of external fins was significantly decreased such that there is a large area of surface between the outer conduit and the cooling air. The second change was that, the hydraulic diameter of the annular space between the inside surface of the outer conduit, and the outside surface of the inner conduit was decreased by more than 50% from Case 3 to Case 4 by increasing the inner conduit outer diameter (and wall thickness to maintain the same inner conduit inner diameter). Third, the aspect ratio of the slots in Case 4 was changed from a narrow deep slot, to a relatively square slot. The aspect ratio (height to width) of the slots in Case 3 was 2.74 and in Case 4 was 0.97. These three changes to the geometry of the atomizing gas passages have a significant effect on the convective heat transfer between the atomizing gas and the inner surface of the outer conduit.

First, having an annular space between the inside surface of the outer conduit and the outside surface of the inner conduit in the region upstream of the external fins on the inner conduit in the hot spot region (location of the outer conduit maximum temperature) of the outer conduit increases the available surface area for heat transfer between the inside surface of the outer conduit and the atomizing gas. Second, decreasing the hydraulic diameter in that region helps in increase the convective heat transfer between the inside surface of the outer conduit and the atomizing gas. Third, widening the slots (and by extension narrowing the fins) by changing their aspect ratio increases the available surface area for heat transfer between the atomizing gas and the inside surface of the outer conduit, without significantly affecting the contact area between the plurality of external fins and the inner surface of the inlet end portion of the spray tip. It is worth noting that the external fins create a barrier to convective heat transfer between the atomizing gas and the inner surface of the outer conduit because there is essentially no flow in the tolerance gap between the outer fin surfaces and the inner surface of the outer conduit. In addition the fins do not play a significant role in radial conduction away (radially inward) from the outer conduit because there is not intimate contact between the outer surfaces of the external fins and the inner surface of the outer conduit. This is in contrast to the intimate and beneficial contact between the outer surfaces of the external fins and the inner surface of the spray tip described earlier. Therefore it is desirable to provide $$0.1 \leq \frac{N \times S}{P} \leq 0.9$$

where N is the quantity of external fins of the plurality of external fins, S is the mean arc length of the external fins of the plurality of external fins, and P is the inner perimeter of the outer conduit at an outer conduit cross section adjacent the plurality of external fins. In addition, the thicker wall of the inner conduit for case 4 allows for greater conduction from the mixing chamber along the length of the inner conduit away from the mixing chamber, thereby lowering the mixing chamber temperature.

These three enhancements help to significantly decrease the maximum outer conduit temperature from 479° C. (Case 3) to 372° C. (Case 4). In turn, this leads to less heat conduction along the wall of the outer conduit to the mixing chamber. The maximum predicted temperature inside of the mixing chamber decreased from 313° C. (Case 3) to 288° C. (Case 4)

The benefit of this configuration is that the mixing chamber is well below the temperature at which coke will form, and the maximum outer conduit temperature is below the temperature range of 430-900° C. where aqueous corrosion due to carbide precipitation (particularly chromium carbide) at the grain boundaries is a concern for most common alloys such as 316, 304, and 310 stainless steels (Roberge, P. R., Handbook of Corrosion Engineering, McGraw-Hill© 2000. Page 712).

Example 6

A comparison was made between the present liquid fuel atomizer and a commercial version of the liquid fuel atomizer described in U.S. Pat. No. 7,500,849, hereinafter, the '849 atomizer. The weld thickness was 1.27 mm and 3.91 mm for the '849 atomizer and the present atomizer, respectively. The cross sectional area of the outer conduit was 117 $mm^2$ and 89 $mm^2$ for the '849 atomizer and the present atomizer, respectively. The wall thickness of the outer conduit was 2.87 mm (0.113 in.) and 3.91 mm (0.154 in.) for the '849 atomizer and the present atomizer, respectively.

The present atomizer had 8 external fins on the outer surface of the inner conduit.

A thermocouple was used to measure the surface temperature of the inside surface of the mixing chamber. Air was passed through the atomizing gas passage at a rate of 5.2 $Nm^3/h$ (3.3 scfm). No liquid fuel was passed through the atomizer. A furnace was heated to about 1150° C. (2100° F.). The different atomizers were inserted an equal depth into the furnace such that the tip of the atomizer was protruding into the furnace. The temperature of the surface inside the mixing chamber was measured. The inner surface temperature of the mixing chamber of the '849 atomizer was about 350° C. with an average furnace temperature of about 1184° C. The inner surface temperature of the mixing chamber of the present atomizer 236° C. with an average furnace temperature of about 1197° C.

Lower temperatures in the mixing chamber are indicative of the potential for reduced coking of the liquid fuel in the spray tip. Since the inner surface temperature of the mixing chamber was lower for the present atomizer compared to the '849 atomizer, coking of the fuel in the spray tip should be reduced.

This invention has been described with reference to particular embodiments, however the invention should not be limited to those embodiments and includes modifications and equivalent arrangements that fall within the scope of the following claims.

We claim:

1. An apparatus for combustion of a liquid fuel, the apparatus comprising:

an outer conduit of generally cylindrical shape having an atomizing gas inlet end portion and an atomizing gas discharge end portion;

an inner conduit of generally cylindrical shape having a liquid fuel inlet end portion and a liquid fuel discharge end portion, the inner conduit disposed within said outer conduit and forming an atomizing gas passage between said outer conduit and said inner conduit, the atomizing gas passage extending from the atomizing gas inlet end portion to the atomizing gas discharge end portion; and a spray tip having an inlet end portion and a discharge end portion, the inlet end portion of the spray tip joined to the atomizing gas discharge end portion of the outer conduit by a weld joint, the spray tip having:

a mixing chamber disposed to receive the liquid fuel from the liquid fuel discharge end portion of the inner conduit and disposed to receive an atomizing gas from the atomizing gas passage, wherein the outlet end of the inner conduit is adjacent to the mixing chamber, and an orifice at the outlet end portion of the spray tip, the orifice disposed to receive the liquid fuel and the atomizing gas from the mixing chamber and for discharging the liquid fuel and the atomizing gas from the spray tip as an atomized liquid fuel, wherein the inner conduit has a plurality of external fins at the liquid fuel discharge end portion of the inner conduit wherein at least some of the plurality of external fins contact an inner surface of the inlet end portion of the spray tip.

2. The apparatus of claim 1 wherein the orifice is an elongated slotted orifice.

3. The apparatus of claim 1 wherein the plurality of external fins have a converging external taper which converges in the direction of the liquid fuel discharge end portion and wherein the spray tip has a converging internal taper at the inlet end portion which converges in the direction of the outlet end portion, the internal taper generally complementary to the external taper of the plurality of external fins.

4. The apparatus of claim 1 wherein the plurality of external fins are longitudinal fins.

5. The apparatus of claim 4 wherein the apparatus has a ratio of length of the plurality of external fins to outer diameter of the outer conduit of 0.1 to 3.0.

6. The apparatus of claim 1 wherein the plurality of external fins are spiral fins.

7. The apparatus of claim 1 wherein the plurality of external fins number from 3 to 20.

8. The apparatus of claim 1 wherein the outer conduit has a ratio of conduit wall thickness to conduit outer diameter of 0.1 to 0.2.

9. The apparatus of claim 1 wherein apparatus has a ratio of atomizing gas passage hydraulic diameter to outer diameter of the outer conduit of 0.05 to 0.25.

10. The apparatus of claim 1 wherein the apparatus has a ratio of inner conduit wall thickness to inner conduit outer diameter of 0.2 to 0.7 at an inner conduit cross section having the plurality of external fins.

11. The apparatus of claim 1 wherein $$0.1 \le \frac{N \times S}{P} \le 0.9$$

where N is the quantity of external fins of the plurality of external fins, S is the mean arc length of the external fins of the plurality of external fins, and P is the inner perimeter of the outer conduit at an outer conduit cross section adjacent the plurality of external fins.

12. The apparatus of claim 1 wherein the weld joint has a thickness of greater than 25% to 100% of the wall thickness of the outer conduit.

13. The apparatus of claim 1 wherein the mixing chamber has a converging internal taper adjacent the orifice which converges in the direction of the orifice.

14. The apparatus of claim 1 further comprising:

a first oxidant gas conduit section defining a first oxidant gas passage, the first oxidant gas passage having a first oxidant gas passage inlet end portion and a first oxidant gas passage discharge end portion for discharging a first oxidant gas stream; and wherein the outer conduit is disposed in spaced relation to the first oxidant gas conduit with at least a part of the outer conduit disposed within the oxidant gas passage.

15. The apparatus of claim 14 further comprising:

a second oxidant gas conduit section defining a second oxidant gas passage proximate the first oxidant gas passage, the second oxidant gas passage for discharging a second oxidant gas stream.

16. The apparatus of claim 15 further comprising:

an oxidant inlet manifold in fluid flow communication with the first oxidant gas passage and the second oxidant gas passage; and a staging valve in downstream fluid flow communication with the oxidant inlet manifold and in upstream fluid flow communication with the second oxidant gas passage for regulating a flow of the second oxidant gas stream to the second oxidant gas passage.

17. The apparatus of claim 14 further comprising:

an oxidant inlet plenum in upstream fluid flow communication of the first oxidant gas passage, at least a portion of the oxidant inlet plenum being spaced around at least a portion of the outer conduit; and an oxidant diffuser located upstream of said oxidant plenum.

18. A method for combusting a liquid fuel comprising:

providing the apparatus of claim 14;

passing a first oxidant gas through the first oxidant gas passage thereby discharging the first oxidant gas stream from the first oxidant gas passage discharge end portion;

passing the liquid fuel through the inner conduit and into the mixing chamber and passing the atomizing gas through the atomizing gas passage and into the mixing chamber thereby forming a mixture of the liquid fuel and the atomizing gas;

passing the mixture of the liquid fuel and the atomizing gas through the orifice thereby discharging the mixture of the liquid fuel and the atomizing gas from the mixing chamber as an atomized liquid fuel into the first oxidant gas stream; and combusting at least a portion of the liquid fuel with at least a portion of the first oxidant gas stream thereby forming a flame.

19. The method of claim 18 wherein the apparatus further comprises a second oxidant gas conduit section defining a second oxidant gas passage, the second oxidant gas passage proximate and below the first oxidant gas passage, the second oxidant gas passage for discharging a second oxidant gas stream, the method further comprising:

passing the second oxidant gas stream through the second oxidant gas passage thereby discharging the second oxidant gas stream below the flame; and combusting at least another portion of the liquid fuel with at least a portion of the second oxidant gas stream.

20. The method of claim 18 wherein the mixture of the liquid fuel and the atomizing gas has a mean residence time in the mixing chamber of from 250 to 1600 microseconds.

21. The method of claim 18 wherein the mixture of the liquid fuel and the atomizing gas is discharged from the spray tip with a velocity, $v_1$, and the first oxidant gas is discharged from the first oxidant gas conduit discharge end portion with a velocity, $v_2$, wherein $$1 \leq \frac{v_1}{v_2} \leq 100.$$

* * * * *